US007110701B2

(12) United States Patent
Facci et al.

(10) Patent No.: US 7,110,701 B2
(45) Date of Patent: Sep. 19, 2006

(54) XEROGRAPHIC CHARGING DEVICE HAVING TWO PIN ARRAYS

(75) Inventors: John S. Facci, Webster, NY (US); Ajay Kumar, Fairport, NY (US); Rachael L. McGrath, Churchville, NY (US); Michael E. Zona, Holley, NY (US); Kenneth W. Pietrowski, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/891,319

(22) Filed: Jul. 14, 2004

(65) Prior Publication Data

US 2006/0013617 A1 Jan. 19, 2006

(51) Int. Cl.
*G03G 15/02* (2006.01)

(52) U.S. Cl. ..... 399/171; 399/173

(58) Field of Classification Search ..... 399/171, 399/173; 361/225, 229; 250/324, 325
See application file for complete search history.

(56) References Cited

U.S. PATENT DOCUMENTS

| | | | | |
|---|---|---|---|---|
| 4,386,837 | A * | 6/1983 | Ando | 399/135 |
| 4,908,513 | A * | 3/1990 | Masuda et al. | 399/100 |
| 5,081,496 | A * | 1/1992 | Takeda | 399/92 |
| 5,666,604 | A * | 9/1997 | Nakagami et al. | 399/171 |
| 5,845,179 | A | 12/1998 | Damji et al. | 399/173 |
| 5,909,608 | A * | 6/1999 | Manno et al. | 399/173 |
| 6,459,873 | B1 | 10/2002 | Song et al. | 399/171 |

FOREIGN PATENT DOCUMENTS

JP 11084816 A * 3/1999

* cited by examiner

*Primary Examiner*—Robert Beatty
(74) *Attorney, Agent, or Firm*—R. Hutter

(57) ABSTRACT

In a xerographic printing apparatus, a scorotron places a uniform charge on a photoreceptor for forming electrostatic latent images. Two conductive pin arrays are disposed in a housing defined by sidewalls and a grid adjacent the photoreceptor. For each array, the distance to the adjacent sidewall is 1.0 to 1.5 the distance to the grid.

9 Claims, 2 Drawing Sheets

XEROGRAPHIC CHARGING DEVICE HAVING TWO PIN ARRAYS

TECHNICAL FIELD

The present disclosure relates to a charging device used in electrostatographic printing or xerography.

BACKGROUND

In the well-known process of electrostatographic or xerographic printing, an electrostatic latent image is formed on a charge-retentive imaging surface, typically a "photoreceptor," and then developed with an application of toner particles. The toner particles adhere electrostatically to the suitably-charged portions of the photoreceptor. The toner particles are then transferred, by the application of electric charge, to a print sheet, forming the desired image on the print sheet. An electric charge can also be used to separate or "detack" the print sheet from the photoreceptor.

For the initial charging, transfer, or detack of an imaging surface, the most typical device for applying a predetermined charge to the imaging surface is a "corotron," of which there are any number of variants, such as the scorotron or dicorotron. Common to most types of corotron is a bare conductor, in proximity to the imaging surface, which is electrically biased and thereby supplies ions for charging the imaging surface. The conductor typically comprises one or more wires (often called a "corona wire") and/or a metal bar forming saw-teeth (a "pin array"), the conductor extending parallel to the imaging surface and along a direction perpendicular to a direction of motion of the imaging surface. Other structures, such as a screen, conductive shield and/or nonconductive housing, are typically present in a charging device, and some of these may be electrically biased as well. A corotron having a screen or grid disposed between the conductor and the photoreceptor is typically known as a "scorotron."

The present disclosure relates to design rules for a scorotron having at least two parallel pin arrays.

PRIOR ART

U.S. Pat. No. 5,845,179 discloses design rules for a corotron, with the objective of minimizing ozone production.

U.S. Pat. No. 6,459,873 discloses a xerographic charging apparatus having two independently-controllable scorotrons.

SUMMARY

There is provided an electrostatographic printing apparatus, comprising a charge receptor and a charge device for applying a charge to a surface of the charge receptor. The charge device includes a housing defining a first interior sidewall and a second interior sidewall, a first pin array and a second pin array disposed between the first interior sidewall and the second interior sidewall of the housing, the first pin array spaced from the second pin array by an array spacing. The first pin array is spaced from the first sidewall by a distance PSS. A grid disposed between the pin arrays and the surface of the charge receptor is spaced from the first pin array by a distance PGS, wherein PSS is between 1.0 and 1.5 PGS.

DETAILED DESCRIPTION

Figure 1:
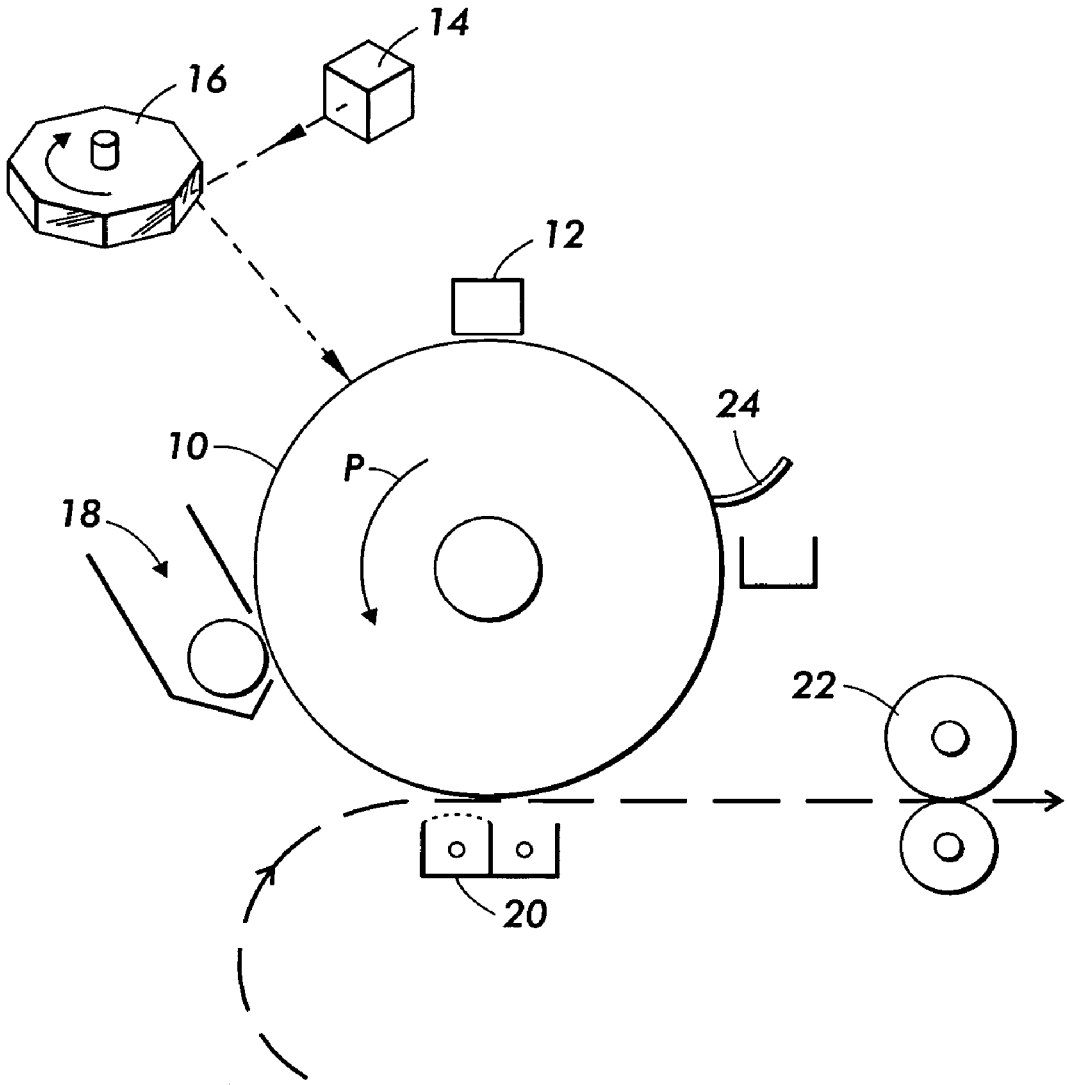
FIG. 1 PRIOR ART
FIG. 1 is an elevational view showing elements of a electrostatographic or xerographic printer.

FIG. 1 is an elevational view showing elements of a electrostatographic or xerographic printer, such as a copier or a "laser printer." There is provided in the printer a charge receptor such as photoreceptor 10, which may be in the form of a belt or drum, and which defines a charge-retentive surface for forming electrostatic images thereon. The photoreceptor 10 is caused to rotate through process direction P.

The first step in the process is the general charging of the relevant photoreceptor surface. This initial charging is performed by a charge device indicated as 12, to impart an electrostatic charge on the surface of the photoreceptor 10 moving past it. The charged portions of the photoreceptor 10 are then selectively discharged in a configuration corresponding to the desired image to be printed, by a raster output scanner or ROS, which generally comprises a laser source 14 and a rotatable mirror 16 which act together, in a manner known in the art, to discharge certain areas of the surface of photoreceptor 10 according to a desired image to be printed. Although the Figure shows a laser 14 to selectively discharge the charge-retentive surface, other apparatus that can be used for this purpose include an LED bar, or, in a copier, a light-lens system. The laser source 14 is modulated (turned on and off) in accordance with digital image data fed into it, and the rotating mirror 16 causes the modulated beam from laser source 14 to move in a fast-scan direction perpendicular to the process direction P of the photoreceptor 10.

After certain areas of the photoreceptor 10 are discharged by the laser source 14, the remaining charged areas are developed by a developer unit such as 18, causing a supply of dry toner to contact or otherwise approach the surface of photoreceptor 10. The developed image is then advanced, by the motion of photoreceptor 10, to a transfer station 20, which causes the toner adhering to the photoreceptor 10 to be electrically transferred to a print sheet, which is typically a sheet of plain paper, to form the image thereon. The sheet of plain paper, with the toner image thereon, is then passed through a fuser 22, which causes the toner to melt, or fuse, into the sheet of paper to create the permanent image. Any residual toner remaining on the photoreceptor 10 can be removed by cleaning blade 24 or equivalent device.

Although a monochrome xerographic print engine is shown in FIG. 1, the above-described elements would be apparent in a color engine, whether such an engine included a single photoreceptor with multiple exposure and development devices, or multiple photoreceptors each transferring toner images onto a common intermediate transfer belt; the present disclosure is applicable to such color devices as well.

Figure 2:
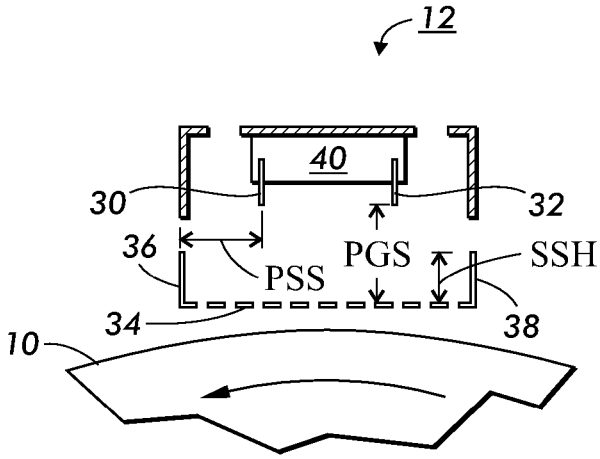
FIG. 2 is an elevational, sectional view of a two-array scorotron.

FIG. 2 is an elevational view of a charge device, in this case a scorotron, such as 12. In this embodiment, two pin arrays, indicated as 30 and 32, are disposed parallel to each other and spaced from each other by an array spacing. A grid 34 is disposed between the pin arrays 30, 32 and a portion of the surface of photoreceptor 10. Integral to the grid are two formed walls that define a first side shield 36 and a second side shield 38. The length of these side shield features, 36 and 38, is defined as "side shield height" or SSH. Each pin array 30, 32 can be held in a substantially insulative mount 40. For the present discussion, the distance between the first pin array 30 and the adjacent sidewall 36 is called the "pin to side shield" or PSS: this can also be the distance between the second pin array 32 and the adjacent sidewall 38. The distance between the close end of the first pin array 30 (or the second pin array 32) and an adjacent surface on grid 34 is called PGS. In this embodiment, PSS is between 1.0 and 1.5 of PGS.

Figure 3:
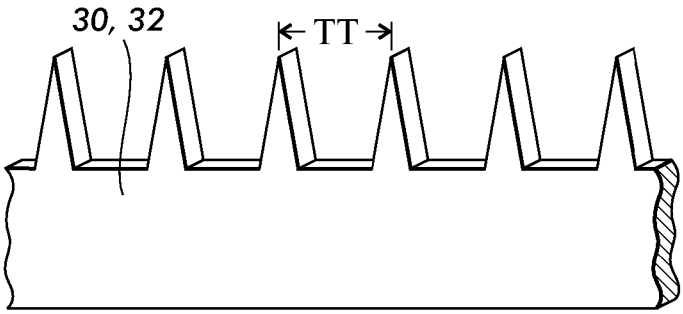
FIG. 3 is an elevational view, orthogonal to the view of FIG. 2, of a portion of a single pin array, in isolation.

FIG. 3 is an elevational view, orthogonal to the view of FIG. 2, of a portion of a single pin array, in isolation. The pin array shown can be either 30 or 32 as shown in FIG. 2. The pin array 30, 32 is a single conductive member, such as of phosphor bronze, defining a set of saw-teeth, or pins, at the edge thereof adjacent the grid 34 as shown in FIG. 2. As shown, the dimension TT relates to a tip-to-tip distance between any adjacent pins formed in the array. In this embodiment, the approximate dimension of TT is 3.0 mm. In operation, each array 30, 32 is biased to a predetermined level (by external means, not shown), as will be described below.

Figure 4:
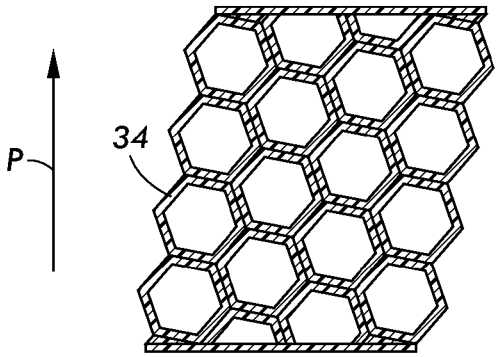
FIG. 4 is a plan view of a grid used in a scorotron such as in FIG. 2.

FIG. 4 is a plan view of a grid 34 used in a scorotron such as in FIG. 2. The grid 34 defines an array of openings in a roughly hexagonal-honeycomb pattern as shown, with an angular bias of 15 degrees relative to the process direction P of photoreceptor 10. In this embodiment, the ration of the total area of the openings to the overall surface area defined by the grid is 75%.

The following list of parameters indicates rules for a practical embodiment of the scorotron 12.

Array Spacing: 8+/−0.2 mm
Pin-Side Shield (PSS): 10.5+/−0.2 mm
Pin-Grid (PGS): 8+/−0.2 mm
Side Shield Height (SSH): 5+/−3 mm
Grid-Photoreceptor distance: 1.2+/−0.15 mm
Open area of grid 34: 75+/−5%
Hole Center to Center of grid 34: 1.25+/−0.25 mm
Current supplied/pin: 9.0+/−2 uA/pin Returning to FIG. 1, the photoreceptor 10 and charge device 12 can be configured as part of a cartridge which is readily removable and repleaceable relative to a larger printing apparatus. Such removable cartridges, as known in the art, may further include a supply of marking material, or the fusing apparatus, as well.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An electrostatographic printing apparatus, comprising:
a charge receptor; and
a charge device for applying a charge to a surface of the charge receptor, the charge device including
a housing defining a first interior sidewall and a second interior sidewall,
a first pin array and a second pin array disposed between the first interior sidewall and the second interior sidewall of the housing, the first pin array spaced from the second pin array by an array spacing, the first pin array spaced from the first sidewall by a distance PSS, and
a grid disposed between the pin arrays and the surface of the charge receptor, the grid spaced from the first pin array by a distance PGS,
wherein PSS is between 1.0 and 1.5 PGS.

2. The apparatus of claim 1, the second pin array being spaced from the second interior wall by PSS and spaced from the grid by PGS.

3. The apparatus of claim 1, wherein the array spacing is 8+/−0.2 mm.

4. The apparatus of claim 1, wherein PSS is 10.5+/−0.2 mm.

5. The apparatus of claim 1, wherein PGS is 8+/−0.2 mm.

6. The apparatus of claim 1, wherein a distance between the surface of the charge receptor and an adjacent surface of the grid is 1.2+/−0.15 mm.

7. The apparatus of claim 1, wherein the grid defines a pattern of holes with a center-to-center spacing of 1.25+/−0.25 mm.

8. The apparatus of claim 1, wherein the side shield height is 5.0+/−3.0 mm.

9. The apparatus of claim 1, wherein the apparatus is in the form of a cartridge which is readily removable from a printing machine.

* * * * *